US005933885A

United States Patent [19]

Glassford

[11] Patent Number: 5,933,885

[45] Date of Patent: Aug. 10, 1999

[54] BABY CRIB BUMPER

[75] Inventor: Clay T. Glassford, 7893 Alpha Rd., Princeton, Minn. 55371

[73] Assignee: Clay T. Glassford, Princeton, Minn.

[21] Appl. No.: 08/928,889

[22] Filed: Sep. 12, 1997

[51] Int. Cl.[6] ..... A47D 15/00; A47D 7/00; A47C 21/08

[52] U.S. Cl. ..... 5/424; 5/946

[58] Field of Search ..... 5/424, 425, 93.1, 5/946, 482

[56] References Cited

U.S. PATENT DOCUMENTS

| | | | |
|---|---|---|---|
| 949,389 | 2/1910 | Almgren . | |
| 2,128,978 | 9/1938 | Akin | 5/93.1 |
| 3,018,492 | 1/1962 | Rosen | 5/93.1 |
| 3,241,158 | 3/1966 | Berl | 5/946 |
| 3,619,824 | 11/1971 | Doyle | 5/93.1 |
| 3,803,646 | 4/1974 | Newerowski | 5/93.1 |
| 3,877,090 | 4/1975 | Schutz | 5/93.1 |
| 4,015,297 | 4/1977 | Christian | 5/93.1 |
| 4,370,765 | 2/1983 | Webber | 5/946 |
| 4,670,923 | 6/1987 | Gabriel et al. | 5/424 |
| 4,783,864 | 11/1988 | Turner | 5/424 |
| 5,010,611 | 4/1991 | Mallett | 5/497 |
| 5,027,456 | 7/1991 | Wadsworth | 5/424 |
| 5,153,954 | 10/1992 | Ohman | 5/93.1 |
| 5,241,718 | 9/1993 | Pope | 5/424 |
| 5,410,765 | 5/1995 | Dicken | 5/93.1 |
| 5,542,135 | 8/1996 | Ozrovitz et al. | 5/424 |
| 5,706,534 | 1/1998 | Sherman | 5/424 |

*Primary Examiner*—Alex Grosz
*Attorney, Agent, or Firm*—Friederichs Law Firm

[57] ABSTRACT

A baby crib bumper for use in a baby's crib such that the bumper pad may remain in place while sheets are changed. A plurality of fasteners and a partial sheet are attached to the bumper pad. The fasteners fasten to the rails of the crib which assists in securing the bumper pads. The partial sheet covers the periphery of the mattress which, also, assists in securing the bumper pad.

7 Claims, 6 Drawing Sheets

418
418
416
416
405
423
410
422
419
415
414
413
412
417

BABY CRIB BUMPER

SPECIFICATION

The present invention relates generally to protecting babies while in their baby cribs. More particularly, the invention concerns an apparatus placed between a crib's side rails and the internal space where the baby is placed.

DISCUSSION OF THE INVENTION

The need for an apparatus which will protect babies from injury while in a baby crib and the ability to change the sheets on the crib's mattress while the apparatus of protection remains on the crib has not been solved.

People use baby cribs as a safe place to put their baby while the baby sleeps. The cribs typically have vertical rails to prevent the baby from falling out of bed while sleeping. These rails are usually located such that a baby can often put his or her head, arms and/or legs through the space between two rails or between the rails and mattress which may cause injury to the baby. The rails are also hard enough that when a baby falls against the rails it may injure the baby.

People developed baby crib bumpers to prevent babies from hitting the rails with their heads and injuring themselves. The baby crib bumpers also assist in reducing the possibility of a baby being able to put his or her head, arms, and/or legs through the spaces between the rails. These baby crib bumpers are typically anchored to the rails with ties. These baby crib bumpers generally do not remain in proper position to protect the baby. These baby crib bumpers generally move vertically which exposes the baby to the possibility of hitting the crib's rails with his or her head. When this happens, the baby may slip between the rails and the mattress.

Some baby crib bumpers are completely connected to a full bed sheet in one manner or another. This sheet is then placed over the mattress or, in some cases, both over and under the mattress and thereby securing the baby crib bumper against the rails. These previous baby crib bumpers, however, created a new problem. This problem is the difficulty in changing the bed sheet without changing the baby crib bumper at the same time.

In the situation where the baby crib bumper and the sheet are connected, a person must wash both the baby crib bumper and the sheet if either one needs to be washed. This makes additional loads of laundry to be washed which takes additional time. Both the sheets and the baby crib bumpers are likely to wear out faster because of the additional, unnecessary washing.

SUMMARY OF THE INVENTION

The present invention provides an innovative baby crib bumper adapted to cribs with rails and a mattress. More particularly, the present invention helps prevent the bumper pad portion from becoming improperly out of place and also allows sheets to be changed without removing the baby crib bumper.

The baby crib bumper may have a plurality of fasteners. The plurality of fasteners may be attached to the rails of the crib to assist anchoring of the bumper pad which prevents the bumper pad from moving away from the rails as well as prevents the bumper pad from moving horizontally.

The bumper pad of the present invention is, also, connected to a partial sheet. The partial sheet is connected to the bottom edge of the bumper pad along the top longitudinal edge of the partial sheet. The partial sheet is placed along the sides of the mattress with the bottom longitudinal edge of the partial sheet part way under the mattress, thus, preventing the bumper pad from moving vertically along the crib's rails. The bumper pad of the present invention remains in the proper position preventing the possibility of a baby putting his or her head through open spaces between the rails, putting his or her head between the mattress and the rails, hitting his or her head on the rails, or having his or her arms and legs become caught between the rails.

The partial sheet is located along the periphery of the mattress. This allows a regular mattress sheet to be placed on the top of the mattress and, then, between the periphery of the mattress and the partial sheet of the invention. The regular mattress sheet can be easily removed and replaced without needing to remove the bumper pad.

The partial sheet may be made of a mesh material. The mesh material is strong, i.e. it does not tear or rip easily. The mesh material is a woven-type of material. The fibers cross at approximately 90 degree angles with the fibers generally more spread out than in ordinary cloth. The fibers which are spread out allow better exchange of air than does plastic or thicker, more compact materials. The mesh material may be a better material to use for a baby crib because of the material's increased capacity to exchange air. If a baby puts his or her head between the mattress and the mesh material, the baby will still be able to breathe through the mesh material. The baby will not fall out between a small mattress and a crib because the mesh will assist in keeping the baby inside the crib.

A person may place a baby crib bumper with a partial sheet made of mesh material on a crib which contains a mattress smaller than the crib. At times, one may run across a crib with a mattress smaller than the frame of the crib. This may occur if one buys a crib at a garage sale or a going out-of-business, mismatch, or "as is" sale. One may receive a crib from a friend or relative that does not have a mattress. The mattress, then purchased, may not be large enough to fill the frame of the crib. In several situations, one may find the mattress smaller than the crib.

The present invention will resolve the problems associated with a mattress which is too small to fill the crib. One problem is that the baby may fall out of the crib between the mattress and the rails because the mattress is too small. Previous baby crib bumpers were not fit to prevent the baby from falling out of the crib between the rails and the mattress. The previous baby crib bumpers only prevented babies from injuring themselves between the rails. In addition, the previous baby crib bumpers that are attached to the mattress sheet will not properly fit a mattress that is too small for the crib. The present invention containing a partial sheet can be anchored to the crib. The partial sheet will prevent the baby from falling out of the crib as well as properly fit a mattress which is too small for the crib.

Another problem associated with a mattress which is too small is that the baby may put his or her face into the space between the mattress and the rails. Previous baby crib bumpers often contained a material, used to anchor the bumper pad to the crib, which was too thick to allow a baby to breathe through it. The present invention with the partial sheet made from a mesh material will enable the baby to breathe because the mesh material is thin enough to allow air to easily pass through it.

The partial sheet's bottom longitudinal edge (edge opposite the bumper pad) may have a tightener. The tightener assists in securing the partial sheet to the mattress. The tightener may be a strip of material which can be tied under the mattress to further secure the baby crib bumper. The strip of material may be an elastic strip which will draw the bottom longitudinal edge towards the center of the mattress and thereby securing the baby crib bumper. The strip of material may be a simple piece of cloth that can be pulled tight and tied beneath the mattress to secure the partial sheet and also the bumper pad.

SECOND ALTERNATIVE EMBODIMENT

The present invention may be an extended single piece bumper pad. This embodiment would be placed in the crib in the same manner as other baby crib bumpers except that the bottom portion of the baby crib bumper would extend along side and under the mattress instead of a partial sheet being placed under the mattress. The invention would be the same as the first embodiment except that the partial sheet is an extension of the bumper pad and may be the same material and may be integral with the bumper pad portion. This embodiment would provide cushion between the mattress and the rails when the crib's mattress is too small for the crib.

THIRD ALTERNATIVE EMBODIMENT

The present invention may be a bumper pad with mesh material along the inside or outside of the bumper pad extending down beyond the bumper pad to allow for placement under the mattress. The partial sheet could be connected at any location along the bumper pad. This embodiment will allow the baby to breathe if his or her head is between the mattress and the rails. This embodiment will prevent the baby from being able to place his or her arms, legs, and/or head through the rails.

FOURTH ALTERNATIVE EMBODIMENT

The present invention may be comprised of a mesh sheet. This embodiment will allow the baby to breathe when his or her face is in the space between the mattress and the rails as well as when the baby's face is very close to the rails. The sheet will also prevent the baby from being able to place his or her head through the rails as well as his or her arms and legs through the rails.

DETAILED DESCRIPTION OF THE INVENTION

The baby crib bumper 5 of the present invention is illustrated in FIGS. 1–5. A partial sheet 14 of the present invention is illustrated in FIGS. 1–5. A plurality of fasteners 16 are illustrated in FIGS. 1–3 and 5.

Figure 1:
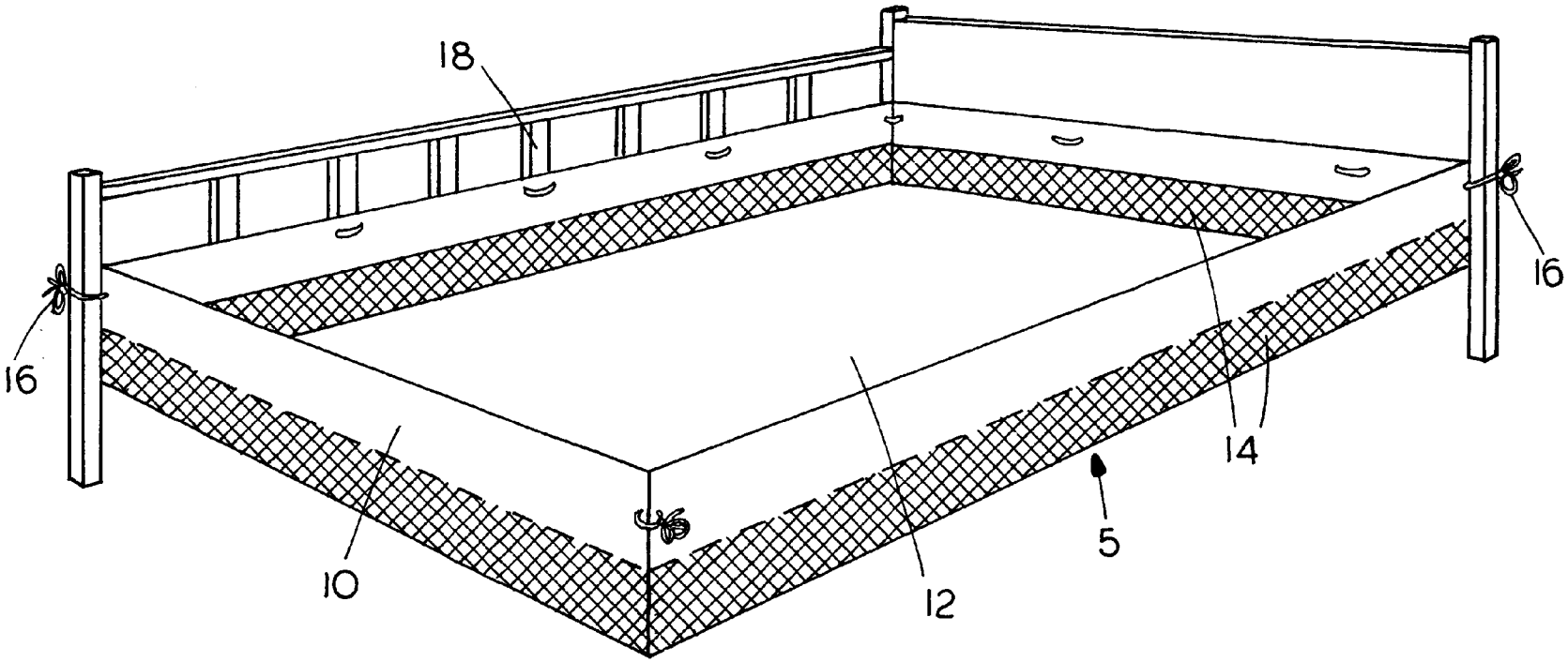
FIG. 1 is a partial prospective top view.
Figure 2:
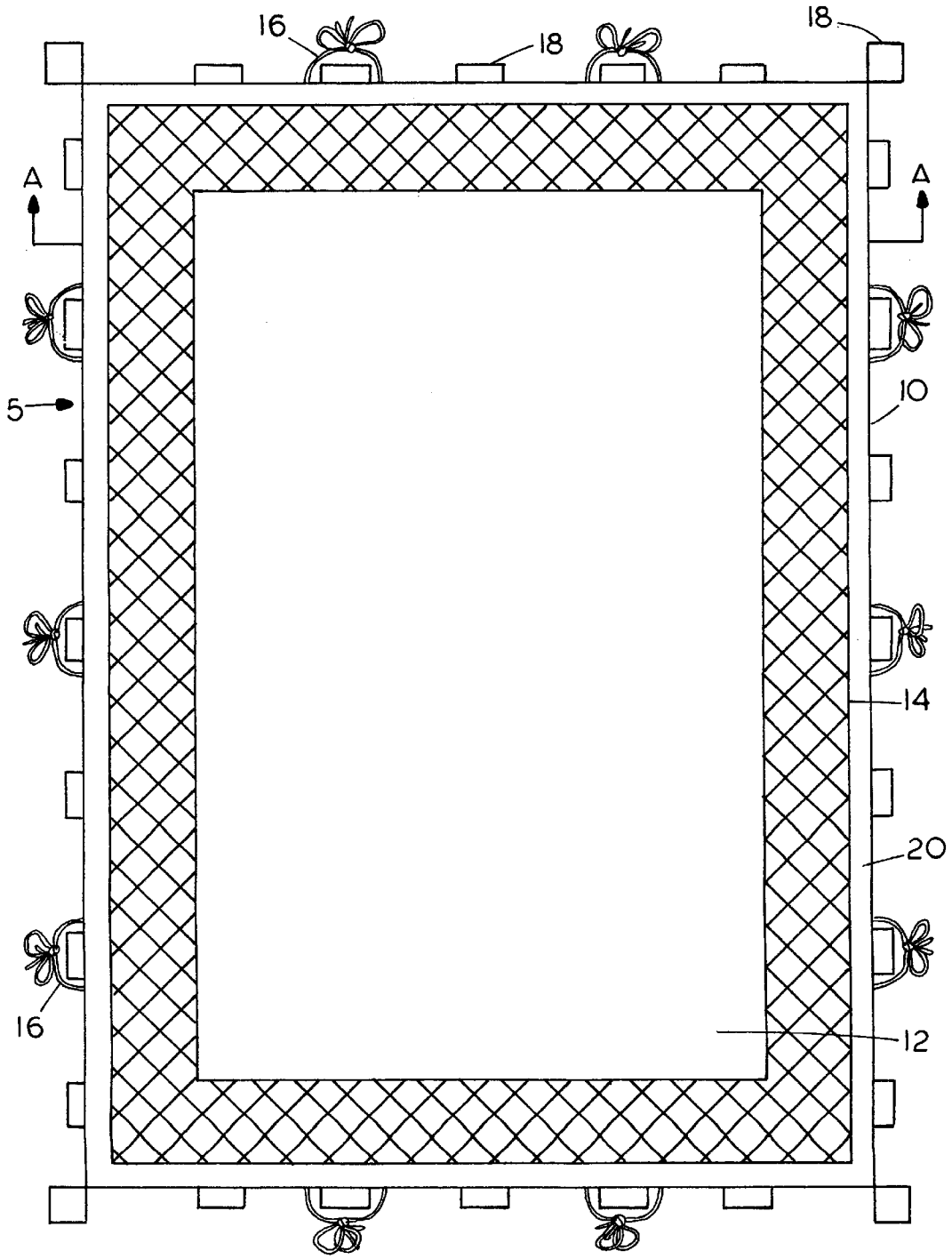
FIG. 2 is a top view.
Figure 3:
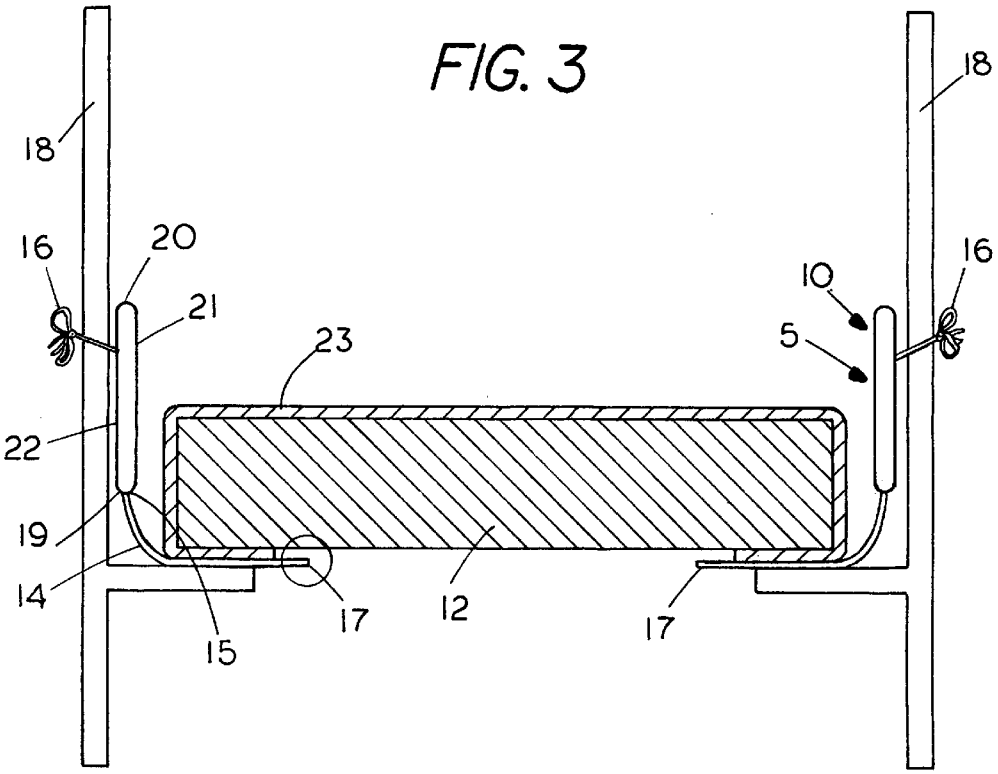
FIG. 3 shows a sectional view of the present invention taken along the line A—A in FIG. 2.

The bumper pad 10 may be made from a foam pad, polyester or other material typically used in making pillows and bumper pads (See FIGS. 1–3). The bumper pad 10 has a front side 21, back side 22, bottom edge 19 and top edge 20 (See FIG. 3).

The partial sheet 14 is made from a mesh material or another material typically used in making sheets. The mesh material is a very loosely woven material. The spaces between the strands of material are further apart than in ordinary cloth which allows increased exchange of air. The partial sheet 14 may be cotton, polyester, nylon, or other materials typically used in making sheets. The partial sheet 14 has a bottom longitudinal edge 17, a top longitudinal edge 15 (See FIG. 3) and a tightener 13 (See FIG. 4). The tightener 13 may be located at the bottom longitudinal edge 17 of the partial sheet 14. The tightener 13 may be separately attached to the partial sheet 14. The tightener 13 may be integral with the partial sheet 14. See FIG. 3.

The partial sheet 14 is attached to the bumper pad 10 along the partial sheet's top longitudinal edge 15 at the bumper pad's bottom edge 19 (See FIG. 3). The partial sheet 14 may be sewn, glued, zippered, or stapled to the bumper pad 10. The partial sheet 14 may have buttons sewn onto it and the bumper pad 10 may have button holes sewn into it (or vice versa) then the partial sheet 14 and the bumper pad 10 can be buttoned together. The partial sheet 14 may contain tie strings which can be tied to the bumper pad 10. The partial sheet 14 may be attached to the bumper pad 10 in any fashion which may be used to secure two pieces of cloth together.

The plurality of fasteners 16 are any products typically used for anchoring baby crib bumpers to cribs. The fasteners 16 may be two ties at several locations; the two ties may be tied around single rails 18 of the crib. The fasteners 16 may be VELCRO™ (2 strips of material, one strip with loops and the other strip with hooks). The fasteners 16 may be a single loop and hook mechanism. The fasteners 16 may be tubes of material which the rails 18 are placed through. The fasteners 16 may be any device which can be used to anchor the baby crib bumper 5 to the crib.

The plurality of fasteners 16 are attached to the bumper pad 10. The fasteners 16 may be sewn, stapled, glued, or zippered to the bumper pad 10. The fasteners 16 may be attached to the bumper pad 10 in any manner one may attach two pieces of cloth to each other. Typically, the fasteners 16 are attached to the bumper pad 10 along the back side 22 of the bumper pad 10 (See FIG. 3). The fasteners 16 may be attached along any portion of the bumper pad 10.

The baby crib bumper 5 may be located in a baby crib. The partial sheet 14 would then be located along the periphery of the mattress 12. A mattress sheet 23 may be placed on top of the mattress 12 and between the mattress 12 and the partial sheet 14 as seen in FIG. 3. The plurality of fasteners 16 are fastened to the crib, usually to the rails 18 of the crib.

The baby crib bumper 5 may be used in conjunction with a mattress 12 which is substantially smaller than the crib as depicted in FIGS. 1–3 and FIG. 5 particularly if the partial sheet 14 is made from a mesh material. If a baby's face is positioned between the rails 18 and the partial sheet 14, the baby is able to breathe through the mesh material and is protected from falling out of the crib.

FIG. 2 shows a top view of the baby crib bumper 5 placed inside of a crib. The plurality of fasteners 16 are shown as ties which are tied around the rails 18. The bumper pad 10 is situated directly inside the crib's rails 18. The mattress 12 is too small for this crib, therefore, one may view the partial sheet 14 from a top view.

Figure 4:
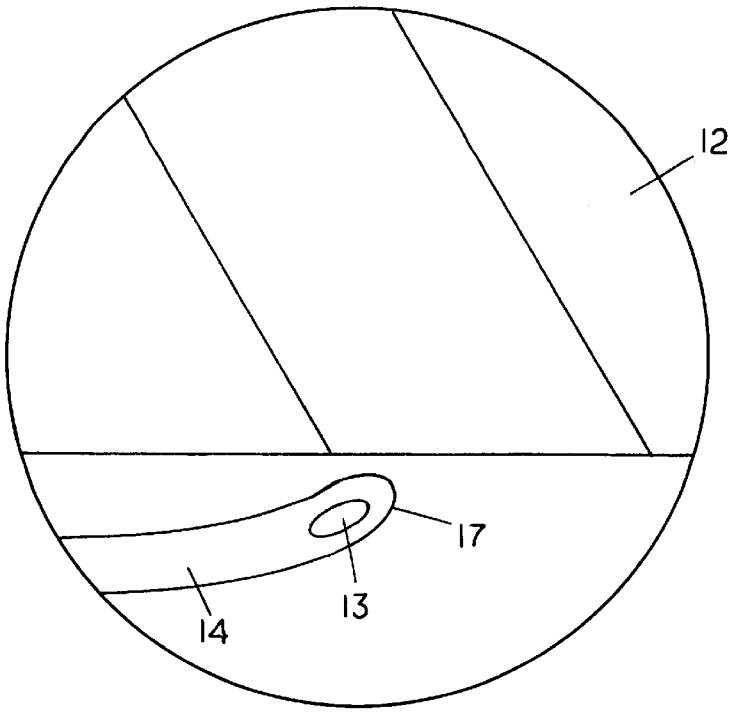
FIG. 4 is a magnified view of the circled portion of FIG. 3.

FIG. 4 shows an enlarged view of the circled portion of FIG. 3. The mattress 12 is located at the top of the drawing. The lower portion of the drawing reveals the partial sheet 14, the bottom longitudinal edge 17, and the tightener 13.

Figure 5:
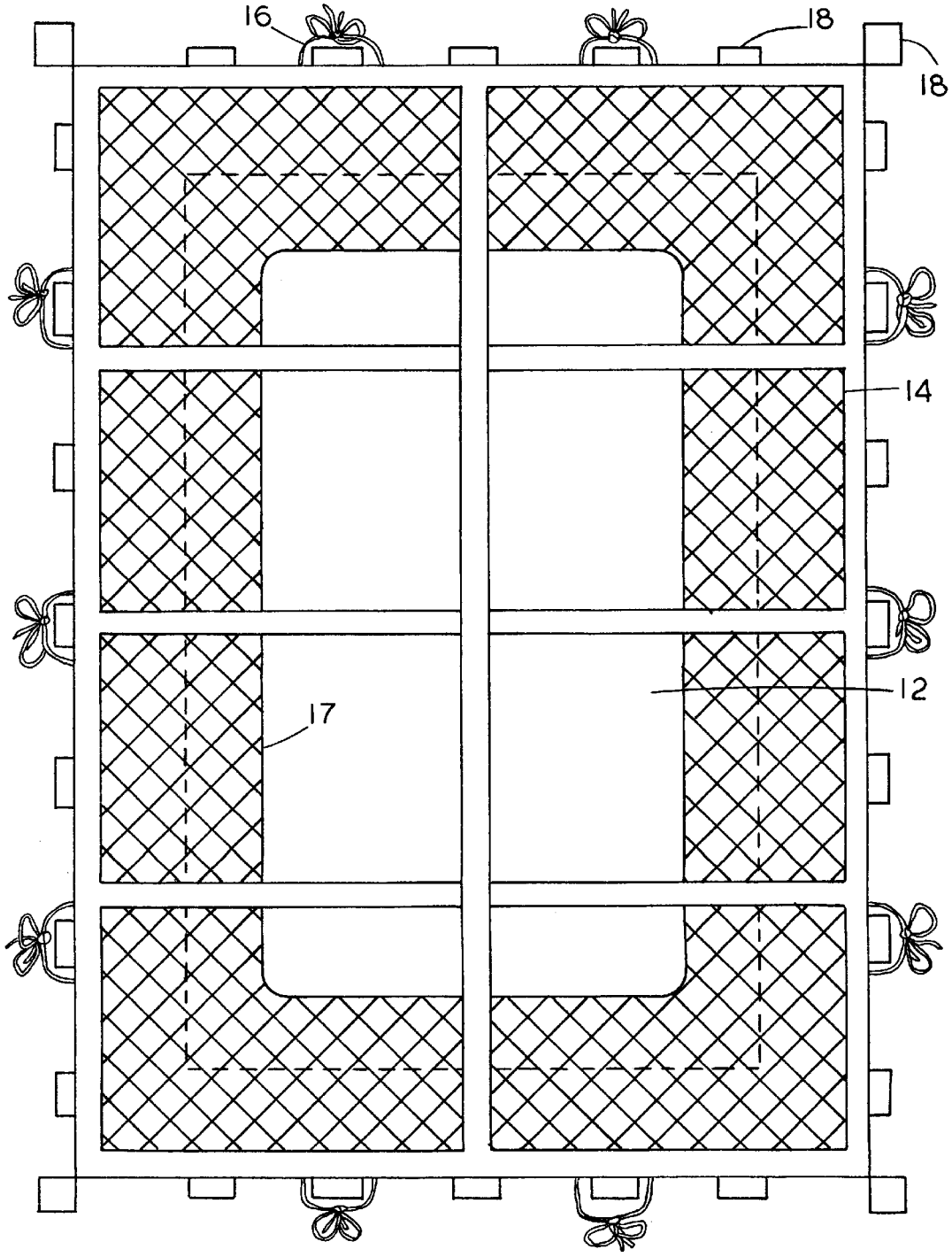
FIG. 5 is a bottom view.

FIG. 5 shows a bottom view of the baby crib and the baby crib bumper 5. The plurality of fasteners 16 are shown as tie strings which are tied around the crib's rails 18. The partial sheet 14 is shown. The mattress 12 is centrally located in FIG. 5. The bottom longitudinal edge 17 of the partial sheet 14 is shown covering the outer portion of the bottom of the mattress 12.

Figure 6:
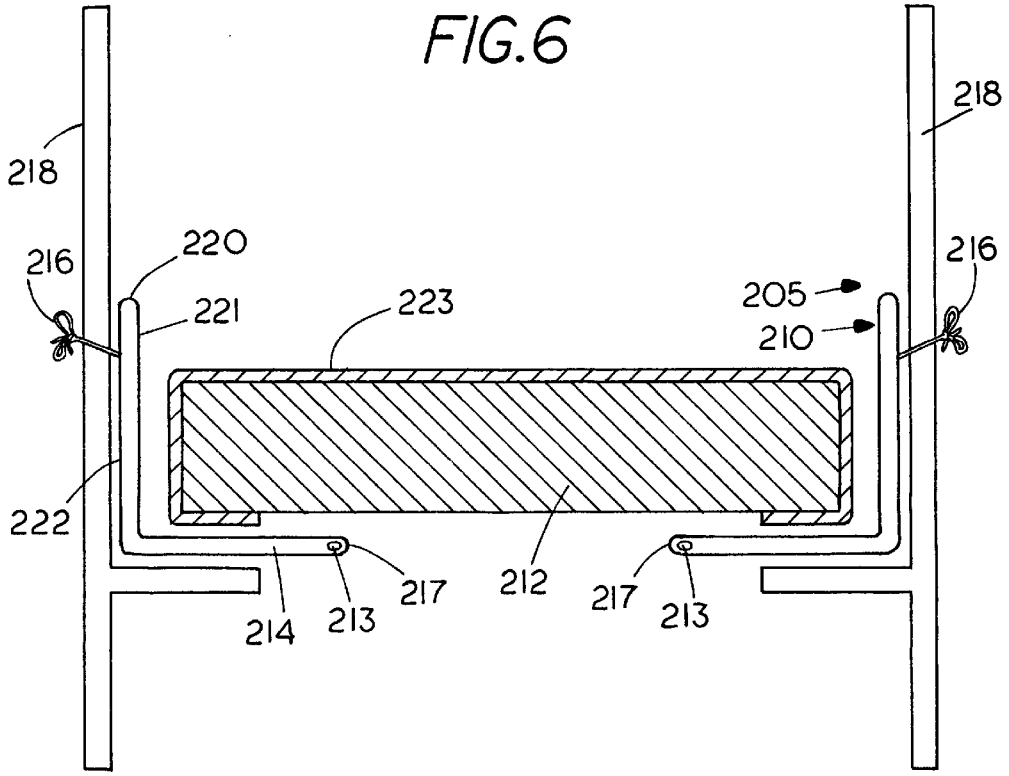
FIG. 6 shows a sectional view of the second embodiment of the present invention.

The second embodiment is shown in FIG. 6. In the second embodiment, the present invention may be an extended single piece baby crib bumper 205. This embodiment would be placed in the crib in the same manner as other baby crib bumpers. The partial sheet 214 would be placed along side and under the mattress 212, similar to the partial sheet 14 in the first embodiment. This embodiment would provide cushion between the mattress 212 and the rails 218 when the crib's mattress 212 is too small for the crib.

The bumper pad 210 has a front side 221, back side 222, and top edge 220. The bumper pad 210 may be made from a foam pad, polyester or other material typically used in making pillows and bumper pads. The partial sheet 214 may be comprised of the same or similar materials from which the bumper pad 210 is made.

The partial sheet 214 has a bottom longitudinal edge 217 and may have a tightener 213 (See FIG. 6). The tightener 213 may be located at the bottom longitudinal edge 217 of the partial sheet 214. The tightener 213 may be separately attached to the partial sheet 214. The tightener 213 may be integral with the partial sheet 214. See FIG. 6.

The partial sheet 214 may be attached to the bumper pad 210. The partial sheet 214 may be sewn, glued, zippered, or stapled to the bumper pad 210. The partial sheet 214 may have buttons sewn onto it and the bumper pad 210 may have button holes sewn into it (or vice versa) then the partial sheet 214 and the bumper pad 210 can be buttoned together. The partial sheet 214 may contain tie strings which can be tied to the bumper pad 210. The partial sheet 214 may be attached to the bumper pad 210 in any fashion which may be used to secure two pieces of cloth together. The partial sheet 214 may be integral with the bumper pad 210.

The plurality of fasteners 216 are any devices typically used for anchoring baby crib bumpers to cribs. The fasteners 216 may be two ties at several locations; the two ties may be tied around single rails 218 of the crib. The fasteners 216 may be VELCRO™ (2 strips of material, one strip with loops and the other strip with hooks). The fasteners 216 may be a single loop and hook mechanism. The fasteners 216 may be tubes of material which the rails 218 are placed through. The fasteners 216 may be any device which can be used to anchor the baby crib bumper 205 to the crib.

The plurality of fasteners 216 are attached to the bumper pad 210. The fasteners 216 may be sewn, glued, stapled, or zippered to the bumper pad 210. The fasteners 216 may be attached to the bumper pad 210 in any manner one may attach two pieces of cloth to each other. Typically, the fasteners 216 are attached to the bumper pad 210 along the back side 222 of the bumper pad 210. The fasteners 216 may be attached to the bumper pad 210 along any portion of the pad.

The baby crib bumper 205 may be located in a baby crib. The bottom edge 217 would then be located under the mattress 212. A mattress sheet 223 may be placed on top of the mattress 212 and between the mattress 212 and the baby crib bumper 205 as seen in FIG. 6. The mattress sheet 223 may be placed along the periphery of the mattress 212. The plurality of fasteners 216 are fastened to the crib, usually to the rails 218 of the crib.

The baby crib bumper 205 may be used in conjunction with a mattress 212 which is substantially smaller than the crib as depicted in FIG. 6. If a baby's face located between the rails 218 and the baby crib bumper 205, the baby is unlikely to be hurt and is protected from falling out of the crib.

In a third embodiment, the present invention may be a baby crib bumper 305 with mesh material extending along the inside or outside of the bumper pad 310 and under the mattress 312. This embodiment will allow the baby to breathe if his or her head is between the mattress 312 and the rails 318 as well as prevent the baby from placing his or her arms or legs through the rails 318.

Figure 7:
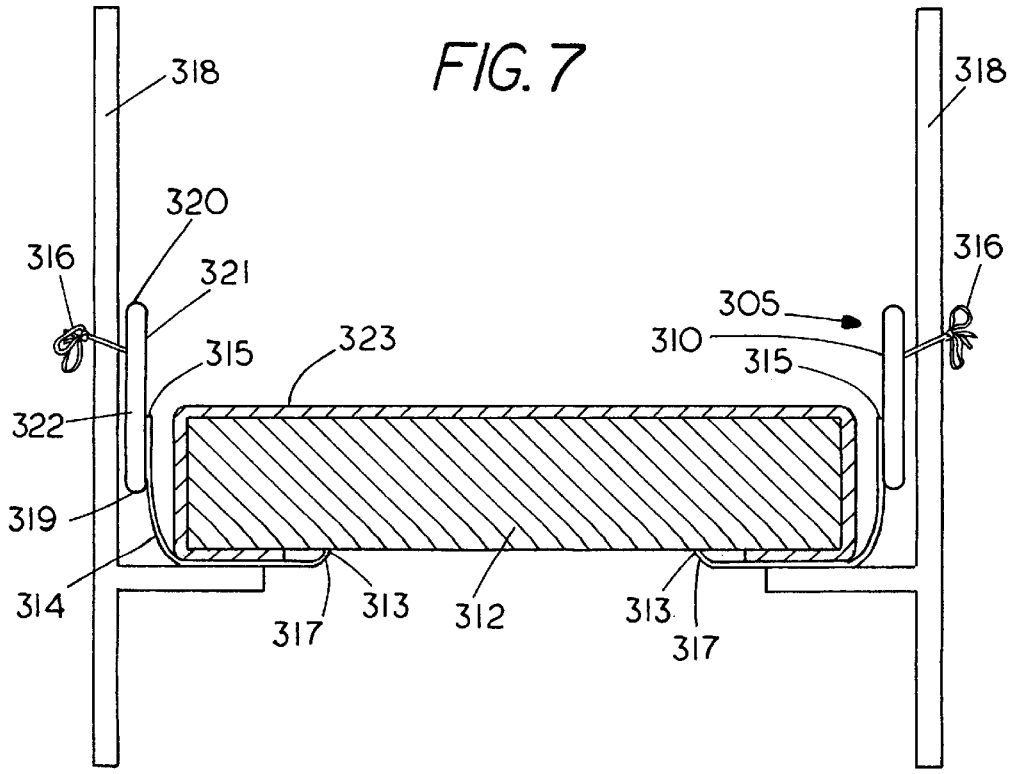
FIG. 7 shows a sectional view of the third embodiment of the present invention.

The baby crib bumper 305 of the present invention is illustrated in FIG. 7. A partial sheet 314 of the present invention is illustrated in FIG. 7. A plurality of fasteners 316 are illustrated in FIG. 7.

The bumper pad 310 may be made from a foam pad, polyester or other material typically used in making pillows and bumper pads. The bumper pad 310 has a front side 321, back side 322, bottom edge 319 and top edge 320 (See FIG. 7).

The partial sheet 314 is made from a mesh material or another material typically used in making sheets. The mesh material is a very loosely woven material. The spaces between the strands of material are further apart than in ordinary cloth which allows increased exchange of air. The partial sheet 314 may be cotton, polyester, nylon, or other materials typically used in making sheets. The partial sheet 314 has a bottom longitudinal edge 317, a top longitudinal edge 315 and a tightener 313 (See FIG. 7). The tightener 313 may be located at the bottom longitudinal edge 317 of the partial sheet 314. The tightener 313 may be separately attached to the partial sheet 314. The tightener 313 may be integral with the partial sheet 314 similar to the first embodiment. See FIG. 7.

The partial sheet 314 is attached to the bumper pad 310 either along the top side 320, the front side 321, or the back side 322 or anywhere else along the bumper pad 310. See FIG. 7 for an example of the partial sheet 314 being attached to the front side 321. The partial sheet 314 may be sewn, glued, or zippered to the bumper pad 310. The partial sheet 314 may be stapled to the bumper pad 310. The partial sheet 314 may have buttons sewn onto it and the bumper pad 310 may have button holes sewn into it (or vice versa) then the partial sheet 314 and the bumper pad 310 can be buttoned together. The partial sheet 314 may contain tie strings which can be tied to the bumper pad 310. The partial sheet 314 may be attached to the bumper pad 310 in any fashion which may be used to secure two pieces of cloth together.

The plurality of fasteners 316 are any devices typically used for anchoring bumper pads to cribs. The fasteners 316 may be two ties at several locations; the two ties may be tied around single rails 318 of the crib. The fasteners 316 may be VELCRO™ (2 strips of material, one strip with loops and the other strip with hooks). The fasteners 316 may be a single loop and hook mechanism. The fasteners 316 may be tubes of material which the rails 318 are placed through. The fasteners 316 may be any device which can be used to anchor the bumper pad 310 to the crib.

The plurality of fasteners 316 are attached to the bumper pad 310. The fasteners 316 may be sewn to the bumper pad 310. The fasteners 316 may be stapled or glued to the bumper pad 310. The fasteners 316 may be zippered to the bumper pad 310. The fasteners 316 may be attached to the bumper pad 310 in any manner one may attach two pieces of cloth to each other. The fasteners 316 may be attached to the bumper pad 310 along the back side 322 of the bumper pad 310 (See FIG. 7).

The baby crib bumper 305 may be located in a baby crib. The partial sheet 314 would then be located along the periphery of the mattress 312. A mattress sheet 323 may be placed on top of the mattress 312 and between the mattress 312 and the partial sheet 314 as seen in FIG. 7. The plurality of fasteners 316 are fastened to the crib, usually to the rails 318 of the crib.

The baby crib bumper 305 may be used in conjunction with a mattress which is substantially smaller than the crib as depicted in FIG. 7 particularly if the partial sheet 314 is made from a mesh material. If a baby's face becomes trapped between the rails 318 and the partial sheet 314, the baby is able to breathe through the mesh material and is protected from falling out of the crib.

In a fourth embodiment 405, the present invention may be a comprised of mesh sheet. This embodiment will allow the baby to breathe when his or her face is in the space between the mattress 412 and the rails 418 as well as when the baby's face is very close to the rails 418. The partial sheet 414 will also prevent the baby from being able to place his or her head through the rails 418 as well as his or her arms and legs through the rails 418.

Figure 8:
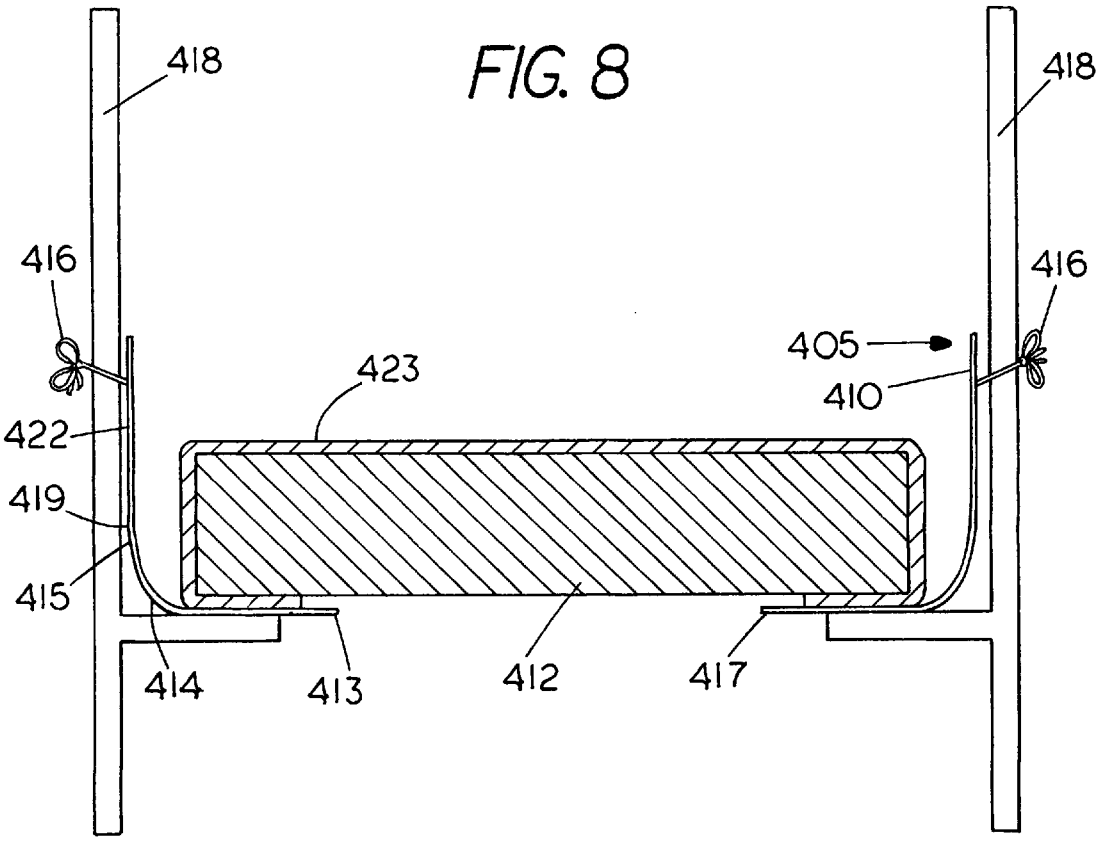
FIG. 8 shows a sectional view of the fourth embodiment of the present invention.

The baby crib bumper 405 of the present invention is illustrated in FIG. 8. A bumper pad 410 and the partial sheet 414 of the present invention is illustrated in FIG. 8.

The partial sheet 414 is made from a mesh material or another material typically used in making sheets. The mesh material is a very loosely woven material. The spaces between the strands of material are further apart than in ordinary cloth which allows increased exchange of air. The partial sheet 414 may be cotton, polyester, nylon, or other materials typically used in making sheets. The partial sheet 414 has a bottom longitudinal edge 417, a top longitudinal edge 415 and a tightener 413 (See FIG. 8) which are all similar to the first embodiment. The tightener 413 may be located at the bottom longitudinal edge 417 of the partial sheet 414.

The tightener 413 may be separately attached to the mesh sheet 414. The tightener 413 may be integral with the mesh sheet 414 which is similar to the first embodiment.

The plurality of fasteners 416 are any devices typically used for anchoring baby crib bumpers 405 to cribs. The fasteners 416 may be two ties at several locations; the two ties may be tied around single rails 418 of the crib. The fasteners 416 may be VELCRO™ (2 strips of material, one strip with loops and the other strip with hooks). The fasteners 416 may be a single loop and hook mechanism. The fasteners 416 may be tubes of material which the rails 418 are placed through. The fasteners 416 may be any device which can be used to anchor the baby crib bumper 405 to the crib.

The plurality of fasteners 416 are attached to the baby bumper pad 410. The fasteners 416 may be sewn, stapled, glued or zippered to the bumper pad 410. The fasteners 416 may be attached to the bumper pad 410 in any manner one may attach two pieces of cloth to each other.

The baby crib bumper 405 may be located in a baby crib. In this embodiment, the bumper pad 410 may be comprised of a mesh material similar to the material of which the partial sheet 414 is comprised. The partial sheet 414 may then be located along the periphery of the mattress 412. A mattress sheet 423 may be placed on top of the mattress 412 and between the mattress 412 and the partial sheet 414 as seen in FIG. 8. The plurality of fasteners 416 are fastened to the crib, usually to the rails 418 of the crib.

The baby crib bumper 405 may be used in conjunction with a mattress 412 which is substantially smaller than the crib as depicted in FIG. 8 particularly if the partial sheet 414 is made from a mesh material. If a baby's face is situated between the rails 418 and the partial sheet 414, the baby is able to breathe through the mesh material and is protected from falling out of the crib.

Having now described the invention in detail, those skilled in this art will have no difficulty in making changes and modifications in the individual parts, sizes or their relative assembly in order to meet specific requirements or conditions. Such changes and modifications may be made without departing from the scope and spirit of the invention, as set forth in the following claims. In particular, it will be readily apparent to those skilled in this art that individual features of the aforementioned examples may be combined and substituted to produce many more equivalent devices.

I claim:

1. A baby crib bumper, adapted to be removably positioned between a crib and a mattress, comprising:

a bumper pad having a back side, a front side, a top edge and a bottom edge, and a plurality of fasteners attached to the back side of the pad, said fasteners adapted to be releasably secured to the crib, a partial sheet, said partial sheet connected to said bumper pad, said partial sheet positionable adjacent to a plurality of vertical sides of a mattress and partially beneath said mattress, whereby when said fasteners are secured to the crib and the partial sheet is partially positioned beneath the mattress, the upward movement of the bumper pad is prevented.

2. The baby crib bumper of claim 1 wherein said partial sheet comprises mesh material.

3. The baby crib bumper of claim 1 wherein said partial sheet has a top longitudinal edge and a bottom longitudinal edge, said top longitudinal edge attached to said bottom edge of said bumper pad, and said bottom longitudinal edge having a tightener.

4. The baby crib bumper of claim 5 wherein said tightener comprises a strip.

5. The baby crib bumper of claim 1 wherein said strip comprises elastic.

6. A baby crib bumper for an infant crib of the type having a horizontal support panel, a mattress sized to substantially cover and rest atop the horizontal support panel, and side rails having slats extending upwardly from the horizontal support panel, said baby crib bumper comprising:

a bumper pad, a partial sheet, a plurality of flexible, elongated fasteners each connected in spaced relation along an outwardly facing surface of said bumper pad, said partial sheet connected to said bumper pad, said partial sheet positioned adjacent to a plurality of vertical sides of a matress and partially beneath said matress whereby, with the mattress removed, when said bumper pad is positioned uprightly against the entire interior perimeter of the crib and said partial sheet is laid substantially flat atop a horizontal support panel, each said fastener is then securable to a corresponding slat of the side rail, the mattress being thereafter positionable atop the horizontal support panel and said partial sheet thereby preventing substantially upward movement of said bumper pad.

7. A baby crib bumper for an infant crib of the type having a horizontal support panel, a mattress sized to substantially cover and rest atop the horizontal support panel, and side rails having slats extending upwardly from the horizontal support panel, said baby crib bumper comprising:

a bumper pad, a partial sheet, a plurality of flexible, elongated fasteners each connected in spaced relation along an outwardly facing surface of said bumper pad, said partial sheet connected to said bumper pad, said partial sheet positioned adjacent to a plurality of vertical sides of a matress and partially beneath said matress whereby, with the mattress removed, when said bumper pad is positioned uprightly against the entire interior perimeter of the crib and said partial sheet is laid substantially flat atop a horizontal support panel, each said fastener is then securable to a corresponding slat of the side rail, the mattress being thereafter positionable atop the horizontal support panel and said partial sheet thereby preventing substantially upward movement of said bumper pad, said partial sheet having a tightener, said tightener further securing said partial sheet in place beneath said matress thereby preventing substantially upward movement of said bumper pad.

* * * * *